US005611533A

United States Patent [19]

Williams

[11] Patent Number: 5,611,533

[45] Date of Patent: Mar. 18, 1997

[54] GRIPPING SLEEVE APPARATUS AND METHOD OF USING THE SAME

[76] Inventor: John P. Williams, 18547 County La., Lansing, Ill. 60438

[21] Appl. No.: 537,411

[22] Filed: Oct. 2, 1995

Related U.S. Application Data

[63] Continuation of Ser. No. 243,478, May 16, 1994, abandoned.

[51] Int. Cl.[6] ..... A63B 59/06

[52] U.S. Cl. ..... 473/568; 473/300; 473/552

[58] Field of Search ..... 273/72 R, 72 A, 273/26 B, 67 R, 67 A, 75; 473/300, 298, 299; 81/427.5

[56] References Cited

U.S. PATENT DOCUMENTS

| | | | |
|---|---|---|---|
| 300,360 | 6/1884 | Gray | 273/72 R |
| 1,860,561 | 5/1932 | Warner | 273/75 |
| 2,904,486 | 5/1961 | Jones | 273/72 R |
| 3,433,481 | 3/1969 | Tanguay | 273/72 R |
| 5,234,740 | 8/1993 | Reeves et al. | 273/75 |

FOREIGN PATENT DOCUMENTS

| | | | |
|---|---|---|---|
| 702449 | 4/1931 | France | 273/75 |

*Primary Examiner*—Mark S. Graham
*Attorney, Agent, or Firm*—Potthast & Ring

[57] ABSTRACT

An improved gripping sleeve for enhancing a hand grip of a shank portion of an object, which provides a tube member having interior and exterior wall surfaces in which the interior wall surface is for engaging the shank portion of the object and an abrasive surface disposed on the interior wall surface of said tube member; including a method for gripping a shank portion of an object having the steps of providing a gripping sleeve (10) comprising a tube member having interior and exterior wall surfaces and having an abrasive surface disposed on said interior wall surface, engaging the interior wall surface of said tube member to the shank portion of the object and gripping the exterior wall surface (20) of the tube member to exert a force (F) onto the shank portion of the object through the interior wall surface of the tube member. The invention includes a layer of material which overlies the surface of the shank portion of the object and in which the layer bonds to the surface of the shank portion and in which the layer has an exterior non-tacky surface in which one embodiment utilizes a granular abrasive material dispersed about and partially embedded in the exterior surface of the layer and another embodiment utilizes an abrasive surface disposed onto the exterior layer in which the abrasive surface includes protrusions integrally formed into the layer.

25 Claims, 3 Drawing Sheets

GRIPPING SLEEVE APPARATUS AND METHOD OF USING THE SAME

This application is a continuation of application Ser. No. 08/243,478, filed May 16, 1994, now abandoned.

BACKGROUND OF THE INVENTION

1. Field of the Invention

This invention is related to gripping sleeves and more particularly to gripping sleeves that engage the shank portion of an object and which are grasped by the user to assist in grasping the object as well as a method for using gripping sleeves.

2. Description of the related art including information disclosed under 37 CFR 1.97–1.99

There are a number of gripping sleeves in the prior art which are used to help a user grip the shank portion of an object. These grips come in various forms and are sometimes found for example in use in gripping different instruments used in sports in which the instruments are used to strike a ball.

It has been common to utilize tape and other adhesives on the lower handle portion of a baseball bat to enhance the gripping capability of the user of the bat. Other sticky substances such as pine tar were utilized in the same fashion to increase the gripping capabilities of the bat. However, these approaches were detrimental in that the gripping capabilities were significantly reduced if dirt and dust accumulated on these items. Also, gripping capabilities degraded when these items became wet. Further, undesirable stains from these items could be easily transmitted to the clothing and gloves of the users.

Other gripping sleeves include U.S. Pat. No. 5,035,428, issued Jul. 30, 1991, to Bartkowicz. In Bartkowicz, the inner surface of the sleeve that is in contact with the bat is a high slip, low friction surface which permits the sleeve to freely rotate over the bat surface when the user makes a swing. The outer surface is of a high friction material such as rubber or similar synthetic which engages the inner surface of a conventional sleeve-type cover grip which secures the sleeve to the bat and in turn is held by the user. However, this gripping sleeve does not utilize an abrasive surface disposed on the interior wall surface of the sleeve and requires the use of a separate conventional sleeve-type cover grip or the like to secure the sleeve to the bat handle. Furthermore, the gripping sleeve is not bonded to the bat and does not utilize abrasive granular material dispersed about and partially embedded in the exterior surface or utilize protrusions integrally formed in the sleeve.

In U.S. Pat. No. 5,238,246, issued Aug. 24, 1993, to Erb the sleeve is made entirely of a slippable material and is secured to the bat under a gripping sleeve. Similarly, Erb does not utilize an abrasive surface disposed on its interior wall surface of the sleeve and requires the use of a separate gripping sleeve to secure the sleeve thereunder. Furthermore, the gripping sleeve is not bonded to the bat and does not utilize abrasive granular material dispersed about and partially embedded in the exterior surface or utilize protrusions integrally formed in the sleeve.

In U.S. Pat. No. 2,984,486, issued May 16, 1961, to L. J. Jones, the gripping sleeve utilizes an adhesive at the interior of the sleeve or is made of an elastic material in which the diameter of the sleeve is slightly smaller than the diameter of the bat handle. This adhesive or elastic material provides the sleeve with the ability to self-secure to the bat handle. L. J. Jones does not provide an abrasive surface disposed on its interior wall surface as the present invention, which in turn, permits the sleeve not to be self-securing and more easily moved to a desired use position and, at the same time, roughens the surface of the bat handle to further enhance the securement of the sleeve to the bat handle when in use. Furthermore, the gripping sleeve does not utilize abrasive granular material dispersed about and partially embedded in the exterior surface or utilize a sleeve that continuously overlies the outer circumferential surface of the shank portion having protrusions integrally formed in the sleeve.

In U.S. Pat. No. 4,134,198, issued Jan. 16, 1979, to Briggs, an elastomeric latex tube is stretched over the handle portion of the bat and is secured thereto by the force exerted by the stretching of the tube and in U.S. Pat. No. 2,659,605, issued Nov. 17, 1953, to G. J. Le Tourneau, sponge like tubes are glued to the handle of the bat. Again, neither of these devices provide for an abrasive surface disposed on the interior wall surface of the sleeve, which in turn, permits the sleeve not to be self-securing and more easily moved to a desired use position and, at the same time, roughens the surface of the bat handle to further enhance the securement of the sleeve to the bat handle when in use. Furthermore, the gripping sleeve is not bonded to the bat and does not utilize abrasive granular material dispersed about and partially embedded in the exterior surface or utilize protrusions integrally formed in the sleeve.

SUMMARY OF THE INVENTION

It is therefore an object of this invention to provide an improved gripping sleeve for enhancing a hand grip of a shank portion of an object, which provides a tube member having an interior and exterior wall surfaces in which the interior wall surface is for engaging the shank portion of the object and an abrasive surface disposed on the interior wall surface of the tube member.

It is a further object of this invention to provide a method for gripping a shank portion of an object having the steps of providing a gripping sleeve comprising a tube member having an interior and exterior wall surfaces and having an abrasive surface disposed on the interior wall surface, engaging the interior wall surface of the tube member to the shank portion of the object and gripping the exterior wall surface of the tube member to exert a force onto the shank portion of the object through the interior wall surface of the tube member.

It is a further object of this invention to provide an improved gripping sleeve for enhancing a hand grip of a shank portion of an object, which provides a layer of material which overlies the surface of the shank portion of the object and in which the layer bonds to the surface of the shank member and in which the layer has an exterior non-tacky surface and a granular abrasive material dispersed about and partially embedded in the exterior surface of the layer.

It is a further object of this invention to provide an improved gripping sleeve for enhancing a hand grip of a shank portion of an object which provides a layer of material which overlies the surface of the shank portion and continuously around the circumference of the shank portion of the object and in which the layer bonds to the surface of the shank member and in which the layer has an exterior non-tacky surface and an abrasive surface disposed onto the exterior layer in which the abrasive surface includes protrusions integrally formed into the layer.

BRIEF DESCRIPTION OF THE DRAWING

The foregoing objects and advantageous features of the invention will be explained in greater detail and others will be made apparent from the detailed description of the preferred embodiment and other embodiments of the present invention which are given reference to the several figures of the drawing, in which.

DETAILED DESCRIPTION

Figure 1:
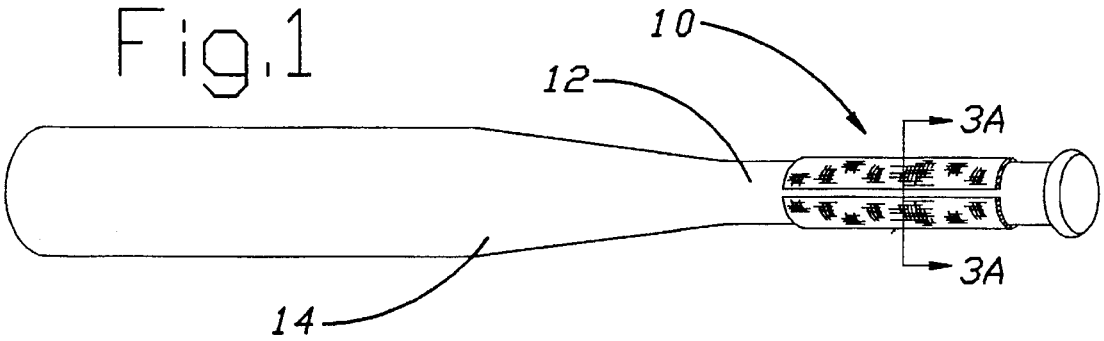
FIG. 1 is a top plan view of the gripping sleeve secured on a baseball bat.
Figure 2:
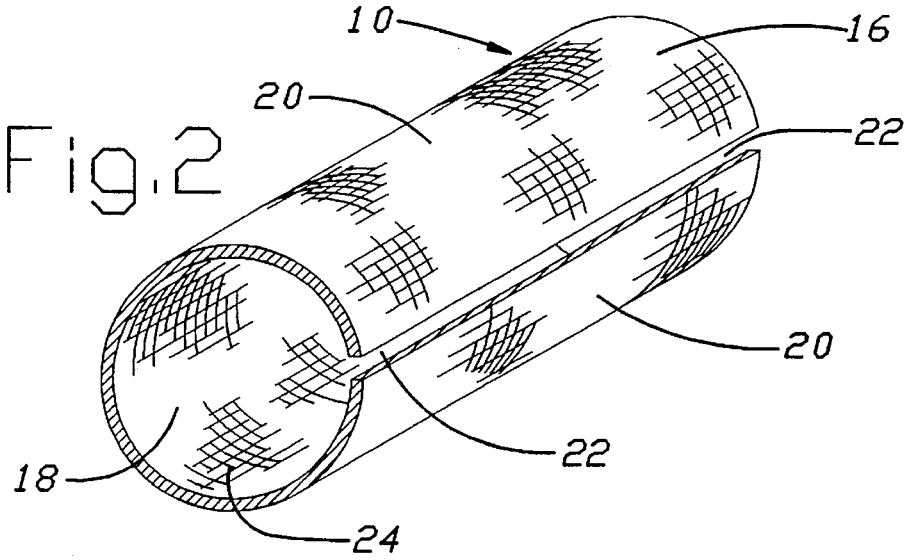
FIG. 2 is an enlarged perspective view of a preferred embodiment of the gripping sleeve.

Referring to FIGS. 1 and 2 of the drawings, improved gripping sleeve 10 is used for enhancing a hand grip of shank portion 12 of object 14 such as a baseball bat and other sporting equipment or other objects that require a firm and secure grip. Gripping sleeve 10 comprises tube member 16 having an interior 18 and exterior 20 wall surfaces in which interior wall surface 18 is for engaging shank portion 12 of object 14.

Tube member 16 is made substantially of a flexible material such as plastic or other suitable material known in the art. The material should be durable and should flex when a gripping force is applied by a person. Yet, it is preferable for the material to have some stiffness in order for the gripping force to be transmitted throughout the tube thereby enhancing the securement of interior surface 18 to shank portion 12 of the object or bat 14.

Figure 3A:
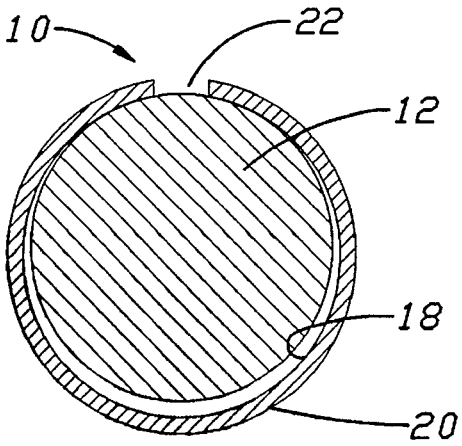
FIG. 3A is an enlarged cross section taken along line 3A—3A of FIG. 1.

It would be additionally desirable for tube 16 to have a slightly larger interior diameter than shank portion 12 and for the material to have some resilience such that when the gripping force F is released tube 16 becomes loose fitting on shank 12, as seen in FIG. 3A. This will permit the user to easily slide sleeve 10 to a desired position along shank 12 prior to gripping sleeve 10 again for use.

Figure 3B:
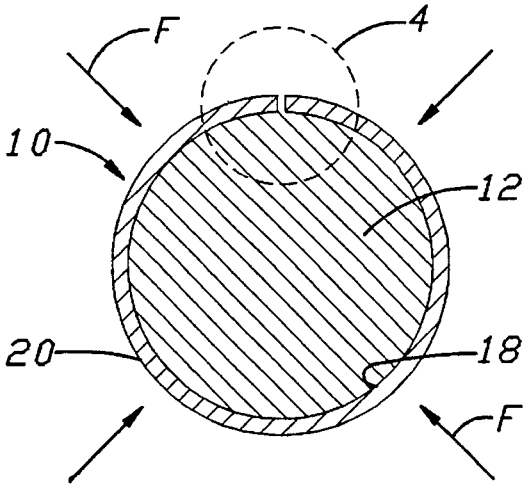
FIG. 3B is an enlarged cross section taken along line 3A—3A of FIG. 1 in which the gripping sleeve is shown in operative position with a gripping force exerted on the sleeve.

Tube member 16 has a split opening 22 disposed through interior and exterior wall surfaces 18, 20. Split opening 22 extends along the entire length of tube member 16. Tube 16 is spread apart at split opening 22 in order to insert shank or handle 12 of object 14 into tube member 16. As seen in FIG. 3A, split opening 22 is wider than as seen in FIG. 3B when gripping force F is applied. It is desirable to have a split opening 22 remain when gripping force F is applied, as seen in FIG. 3B, in order for the edges of opening 22 not to buckle upon one another. However, the present invention does contemplate that opening 22 would completely close up if the ends of tube 16 which define opening 22 overlap when the gripping force F is applied, as well.

Shank portion 12 of object 14 in the present drawing is the handle area of baseball bat 14. The bat in this case can be traditionally made of wood or aluminum. It is desirable for the length of tube member 16 to be at least the width of one human hand and preferably two hands. As discussed above, tube 16 can be moved in its relaxed position to a desired location along shank or bat handle 14 and then gripped by the user. Having a secure grip under two hands of the user will only provide more safety of the bat remaining in the hitter's hands when in use.

Figure 4A:
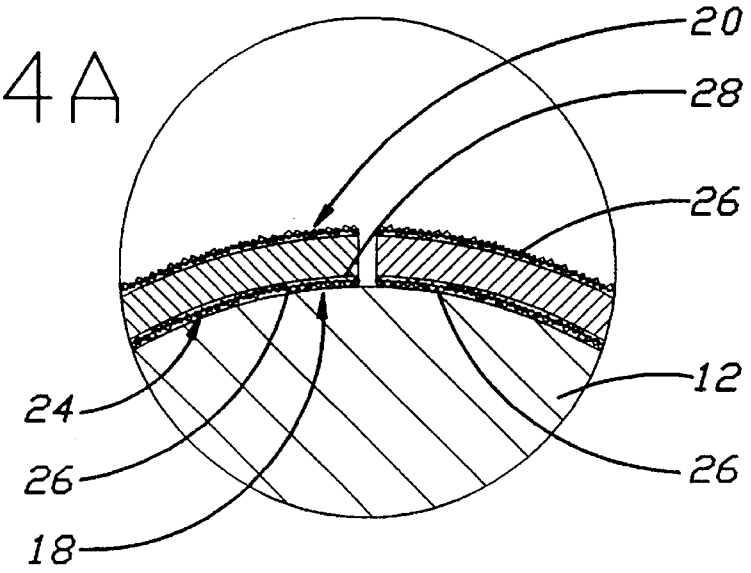
FIG. 4A is an enlarged view of that which is shown in circle 4 of FIG. 3B of a preferred embodiment.

This improved gripping sleeve 10 for enhancing hand grip of shank portion 12 of object 14 includes abrasive surface 24 disposed on interior wall surface 18 of tube member 16. Abrasive surface 24 includes granular material 26, as seen in FIG. 4A, secured onto interior wall surface 18 of tube member 16. This granular material 26 is preferably durable and provides a rough surface that will abrade and provide a reliable securement to wood and even aluminum bats. Abrading the surface of the wood or aluminum will further enhance the securement by providing additional mechanical resistance between the surface of object 14 and interior surface 18. A typical granular material 26 is Aggregate, a trademark of Ultra Polymers, Inc., of Indianola, Pa., of grade no. 80. Other grades of this material can be used, as well as many other common granular materials that would provide an abrasive surface.

In a preferred embodiment, as seen in FIG. 4A, granular material 26 is secured to interior wall surface 18 of tube member 16 by securing means 28 as seen in FIG. 4A. Securing means 28 is a glue and preferably one that dries and will not readily allow dust or dirt to accumulate upon it. Preferably a nontoxic epoxy is used such as Ultrathane, a trademark of Ultra Polymers, Inc., mentioned above. However, any other suitable adhesive known in the art can be used.

In a preferred embodiment, as seen in FIG. 4A, abrasive surface 24 is also disposed on exterior wall surface 20 of tube member 16. Thus, not only is abrasive surface 24 provided on interior wall surface 18 to contact shank portion 12 but also on exterior wall surface 20 to engage the hands of the user or the gloves of the user. Similarly, abrasive surface 24 includes granular material 26 secured onto exterior wall surface 20 of tube member 16 as described above for interior wall surface 18. Likewise, similar securing means 28 for securing granular material 26 onto exterior wall surface 20 will be used as described above for the interior wall surface 18. It would be easier for gripping sleeve 10 to be constructed with interior 18 and exterior 20 wall surfaces having the same abrasive surface 24 disposed respectively thereon. In this preferred embodiment, securing means 28 is coated upon interior and exterior 18, 20 wall surfaces of tube 16 and then the surfaces 18, 20 have granular material 26 spread over these coated surfaces and allowed to dry.

This granular material 26 is typically randomly spread over the coated surfaces 18, 20 and end up with the grains being irregularly spaced with respect to each other. This spacing provides less likelihood for regular spaces or grooves to be formed in which to trap or accumulate and compact therein dust or dirt.

Figure 4B:
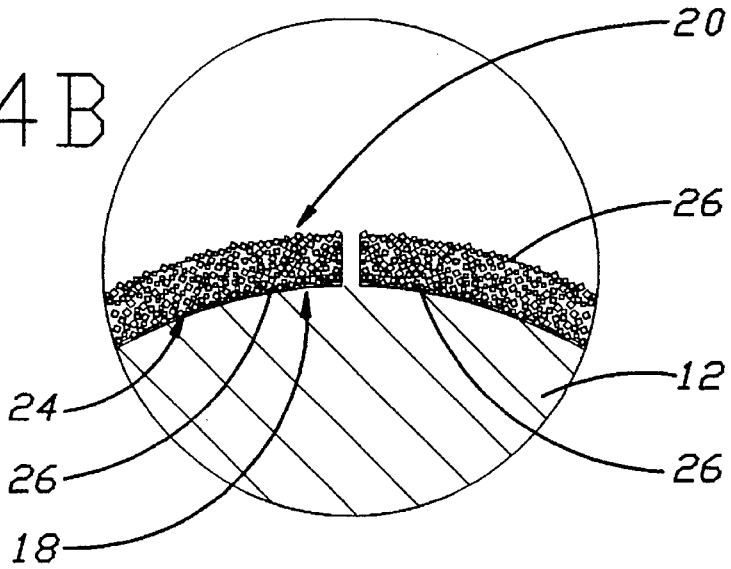
FIG. 4B is an enlarged view of that which is shown in circle 4 of FIG. 3B of another embodiment.

Another embodiment of improved gripping sleeve 10, is shown in FIG. 4B, in which the abrasive surface 24 includes granular material 26 partially embedded into interior wall surface 18 of tube member 16. Again, it is preferable for abrasive surface 24 to also be disposed on exterior wall surface 20 of tube member 16.

Abrasive surface 24 includes granular material 26, much like the granular material discussed above, partially embedded into exterior wall surface 20 or interior wall surface 18 of tube member 16. The granular material 26 can be incorporated within the material that composes tube member 16 and be fabricated to permit grains to project out of the surface and be partially embedded within the material that composes tube 16. Again, the granular material 26 is preferably randomly dispersed within the material that composes tube 16 and thereby the grains 26 that are partially embedded become irregularly spaced. The benefit of this irregular spacing is discussed above.

Figure 4C:
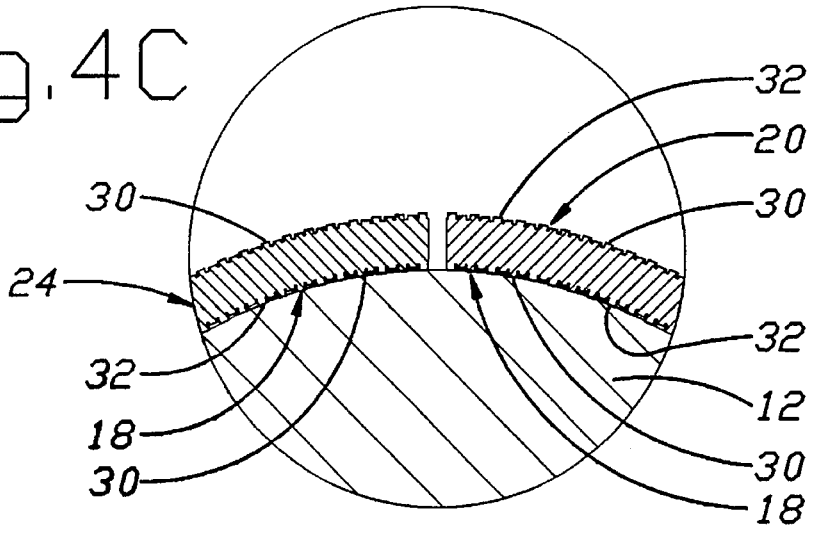
FIG. 4C is an enlarged view of that which is shown in circle 4 of FIG. 3B of yet another embodiment.

In yet another embodiment, abrasive surface 24, as seen in FIG. 4C, includes protrusions 30 integrally formed in interior wall surface 18. Typically, abrasive surface 24 can be formed at the time tube member 16 is molded. Again, it is preferable to have protrusions 30 integrally formed also in exterior wall surface 20. At least some of protrusions 30 have peaks 32 which enhance abrasiveness. Protrusions 30 are also irregularly spaced for the same reasons as discussed above.

The present invention provides a new method for gripping shank portion 12 of object 14. This method includes the steps of providing gripping sleeve 10 comprising tube member 16 having interior 18 and exterior 20 wall surfaces and having abrasive surface 24 disposed on interior wall surface 18. The method further includes engaging interior wall surface 18 of tube member 16 to shank portion 12 of object 14. Further, the method includes gripping exterior wall surface 20 of tube member 16 by exerting a force F onto shank portion 12 of object 14 through interior wall surface 18 of tube member 16. This gripping is easily accomplished with the user grasping exterior wall surface 20 when holding bat 14.

Again, it is preferable to have abrasive surface 24 also disposed on exterior wall surface 20. As discussed above, with both interior and exterior 18, 20 wall surfaces having abrasive surfaces 24, the gripping capabilities and therefore the safety of continuing to grasp object 14 while in use is enhanced.

Slit 22 along the length of tube 16 permits spreading tube 16 open at and along slit 22 to dispose shank portion 12 of object 14 into tube member 16 and then permit it to close in the step of engaging the interior wall surface 18 of tube member 16.

Figure 5:
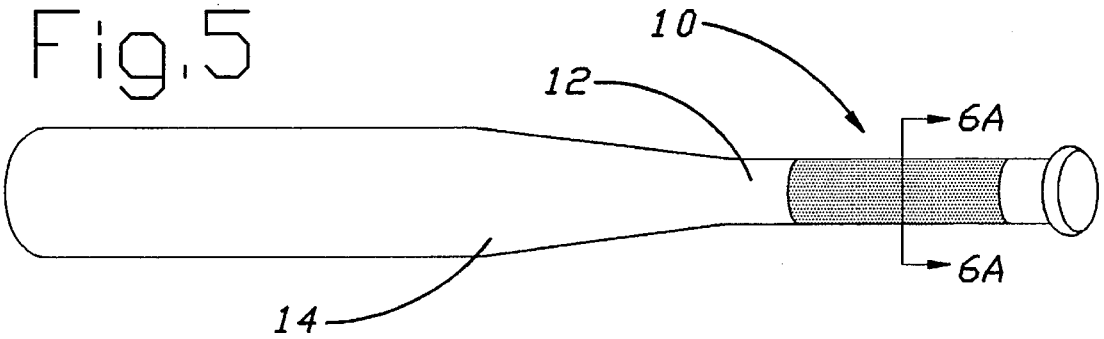
FIG. 5 is a top plan view of another embodiment of the gripping sleeve.
Figure 6A:
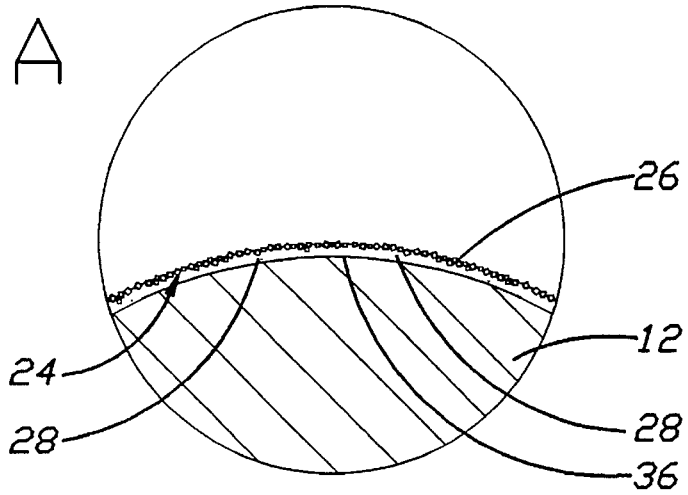
FIG. 6A is an enlarged partial cross sectional view taken along line 6A—6A of FIG. 5.

The present invention also provides for another embodiment, as seen in FIGS. 5 and 6A, of gripping sleeve 10 for enhancing hand grip of shank portion 12 of object 14 which provides layer of material 28 which overlies surface 36 of shank portion 12 of object 14 and in which layer 28 bonds to surface 36 of shank portion 12 and in which layer 28 has an exterior non-tacky surface, such as epoxy glue, paint, plastic material formed onto surface 36 of shank portion 12, or other suitable material with a non-tacky exterior surface known in the art.

Shank portion 12 is handle portion of bat 14 or other sporting equipment or other objects that require a firm and secure grip. The bat in this case can be traditionally made of wood or aluminum. It is desirable for the length of layer 28 to be at least the width of one human hand and preferably two hands. Having a secure grip under two hands of the user will only provide more safety of the bat remaining in the hitter's hands when in use as previously discussed above.

Still referring to FIGS. 5 and 6A, a granular abrasive material 26 is dispersed about and partially embedded in exterior surface 36 of layer 28. This granular material 26 is preferably durable. A typical granular material 26 is Aggregate, a trademark of Ultra Polymers, Inc., of Indianola, Pa., of grade no. 80. Other grades of this material can be used, as well as many other common granular materials that would provide an abrasive surface. Typically, layer 28 is applied to surface 36 in a liquid or near liquid state and prior to layer 28 setting up and hardening, granular material 26 is randomly dispersed about layer 28. As a result, a preferable embodiment has granular material 26 dispersed in an irregular spacing for benefits previously discussed.

Figure 6B:
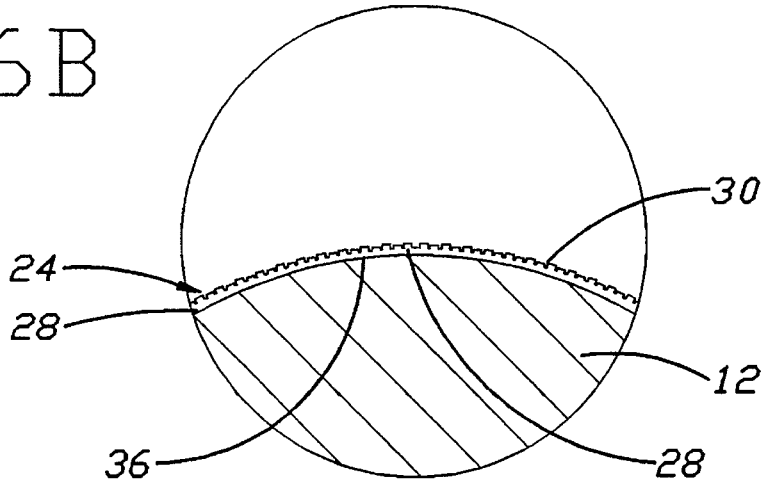
FIG. 6B is an enlarged partial cross sectional view of another embodiment of the invention taken along line 6A—6A of FIG. 5.

Referring now to FIG. 6B, another embodiment of this invention is taught which has layer of material 28 which overlies surface 36 of shank portion 12 continuously around the circumference of shank portion 12 of object 14 and in which layer 28 bonds to surface 36 of shank member 12 and layer 28 has an exterior non-tacky surface. Layer 28 is molded plastic, or other suitable material with a non-tacky exterior surface known in the art.

Still referring to FIG. 6B, abrasive surface 24 disposed onto exterior layer 36 of shank portion 12 of object 14 in which abrasive surface 24 includes protrusions 30 integrally formed into layer 28. Protrusions 30 are irregularly spaced.

Typically, a plastic in a liquid or other easily moldable state is disposed around preferably the entire circumference of shank portion 12 and is bonded to the surface 36 of bat 14 and, at the same time or subsequent thereto, that the plastic is bonded protrusions 30 are molded in layer 28. As a result, protrusions 30 are formed in layer 28 and are engaged by the user's hands when gripping shank portion 12.

Shank portion 12 is a handle of a baseball bat or other sporting equipment or other objects that require a firm and secure grip as discussed above.

While a detailed description of the preferred embodiment of the invention have been given, as well as a couple other embodiments, it should be appreciated that many variations can be made thereto without departing from the scope of the invention as set forth in the appended claims.

What is claimed is:

1. A gripping sleeve adapted to fit a sports implement handle for enhancing a hand grip of a shank portion comprising:

an elongate resiliently flexible hollow cylindrical tube member with a cylindrical shape formed independent of the shank portion in which said tube member is slidable along said shank portion with said cylindrical tube in engagement with said shank portion, having interior and exterior wall surfaces, in which the interior wall surface is for engaging the shank portion of the handle; and an abrasive surface disposed on the interior wall surface of said tube member in which said flexible hollow cylindrical tube member engaged to said shank portion flexes toward said shank portion and said abrasive surface engages said shank portion with the application of a gripping force to said cylindrical tube member resisting said tube member from sliding upon said shank portion and in which said cylindrical tube member flexes away from said shank portion and is slidable along said shank portion with a release of said gripping force.

2. The improved gripping sleeve of claim 1 in which said resiliently flexible hollow cylindrical tube member is constructed of plastic.

3. The improved gripping sleeve of claim 1 in which the tube member has a split opening disposed through the interior and exterior wall surfaces.

4. The improved gripping sleeve of claim 3 in which the split opening extends along the length of the tube member.

5. The improved gripping sleeve of claim 4 in which the split opening extends along the entire length of the tube member.

6. The improved gripping sleeve of claim 1 in which the tube member is adapted to engage the handle area of a baseball bat and having a length at least the width of one human hand.

7. The improved gripping sleeve of claim 1 in which the abrasive surface includes granular material secured onto and over substantially the entire length of said interior wall surface of said tube member for directly engaging said shank portion.

8. The improved gripping sleeve of claim 7 includes an abrasive surface disposed on the exterior wall surface of said tube member.

9. The improved gripping sleeve of claim 8 in which the abrasive surface on the exterior wall surface includes granular material secured onto said exterior wall surface of said tube member.

10. The improved gripping sleeve of claim 7 in which the granular material is irregularly spaced.

11. The improved gripping sleeve of claim 7 includes a means for securing said granular material onto said interior wall surface of said tube member.

12. The improved gripping sleeve of claim 11 in which the securing means includes a glue.

13. The improved gripping sleeve of claim 1 in which the abrasive surface includes granular material partially embedded into said interior wall surface of said tube member.

14. The improved gripping sleeve of claim 13 includes an abrasive surface disposed on the exterior wall surface of said tube member.

15. The improved gripping sleeve of claim 14 in which the abrasive surface includes granular material partially embedded into said exterior wall surface of said tube member.

16. The improved gripping sleeve of claim 15 in which the partially embedded material is irregularly spaced.

17. The improved gripping sleeve of claim 1 in which the abrasive surface includes protrusions integrally formed in said interior wall surface.

18. The improved gripping sleeve of claim 17 further including an abrasive surface disposed on the exterior wall surface of said tube member.

19. The improved gripping sleeve of claim 18 in which the abrasive surface on the exterior surface includes protrusions integrally formed in said exterior wall surface of said tube member.

20. The improved gripping sleeve of claim 17 in which at least some of the protrusions have peaks.

21. The improved gripping sleeve of claim 20 in which the protrusions are irregularly spaced.

22. The improved gripping sleeve of claim 1 which includes an abrasive surface disposed on said exterior wall surface.

23. A method for gripping utilizing a gripping sleeve adapted to grip a sports implement handle including the steps of:

providing the gripping sleeve with an elongate resiliently flexible hollow cylindrical tube member with a cylindrical shape formed independent of the shank portion in which said tube member is slidable along said shank portion with said cylindrical tube in engagement with said shank portion having an interior and exterior wall surfaces and having an abrasive surface disposed on said interior wall surface;

engaging the cylindrical tube member to said shank portion and positioning said interior wall surface of said tube member to overlie the shank portion at a desired position; and applying a gripping force to the exterior wall surface of the tube member exerting a force onto said hollow tube member flexing said hollow tube member toward said shank portion engaging said abrasive surface to said shank portion resisting said tube member from sliding upon said shank portion and allowing said tube member to flex away from said shank portion and be slidable along the shank portion with a release of said gripping force.

24. The method of claim 23 further including an abrasive surface disposed on the exterior wall surface.

25. The method of claim 23 in which the tube member is constructed of plastic and in which the tube member has a slit along the length of the tube in which the step of engaging the cylindrical tube member to said shank portion and positioning the interior wall surface to overlie the shank portion includes spreading the tube open at and along the slit to dispose the shank portion into the tube member.

* * * * *